US009134663B2

(12) United States Patent
Matsunaka et al.

(10) Patent No.: US 9,134,663 B2
(45) Date of Patent: Sep. 15, 2015

(54) ELECTROPHOTOGRAPHIC FIXING MEMBER, FIXING APPARATUS AND ELECTROPHOTOGRAPHIC IMAGE FORMING APPARATUS

(71) Applicant: CANON KABUSHIKI KAISHA, Tokyo (JP)

(72) Inventors: Katsuhisa Matsunaka, Inagi (JP); Kazuo Kishino, Yokohama (JP); Katsuya Abe, Tokyo (JP); Takeshi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/280,891

(22) Filed: May 19, 2014

(65) Prior Publication Data

US 2014/0255067 A1 Sep. 11, 2014

Related U.S. Application Data

(63) Continuation of application No. PCT/JP2013/007440, filed on Dec. 18, 2013.

(30) Foreign Application Priority Data

Dec. 26, 2012 (JP) ..... 2012-282976
Dec. 5, 2013 (JP) ..... 2013-251804

(51) Int. Cl.
*G03G 15/20* (2006.01)

(52) U.S. Cl.
CPC .... *G03G 15/2057* (2013.01); *G03G 2215/2035* (2013.01)

(58) Field of Classification Search
CPC ..... G03G 15/2057; G03G 15/20; G03G 15/2053; G03G 2215/2035
USPC ..... 399/333
See application file for complete search history.

(56) References Cited

U.S. PATENT DOCUMENTS 7,879,442 B2 * 2/2011 Morita et al. ..... 428/372
7,974,563 B2 * 7/2011 Sakai et al. ..... 399/333

(Continued)

FOREIGN PATENT DOCUMENTS

JP 2001-62380 A 3/2001
JP 2002-213432 A 7/2002

(Continued)

OTHER PUBLICATIONS

Dennetsu Kogaku Shiryo (Heat Transfer Engineering Information), 4th Ed., the Japan Society of Mechanical Engineers, pp. 30-31 (1986).

(Continued)

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An elastic layer of the fixing member contains a silicone rubber, an inorganic filler and vapor grown carbon fibers, relationships of $3X+30Y \leq 170$, $25 \leq X \leq 50$ and $0.5 \leq Y \leq 3.1$ are satisfied when a volume percent of the inorganic filler compounded in the elastic layer is expressed by X (%) and a volume percent of the vapor grown carbon fibers compounded in the elastic layer is expressed by Y (%), and a ratio of a fiber length to a fiber diameter of the vapor grown carbon fibers, aspect ratio, is 50 or more.

12 Claims, 8 Drawing Sheets

(56) References Cited

U.S. PATENT DOCUMENTS

| | | | | |
|---|---|---|---|---|
| 8,005,413 | B2 | 8/2011 | Sakakibara et al. | |
| 8,224,223 | B2 | 7/2012 | Sakakibara et al. | |
| 8,369,763 | B2 | 2/2013 | Sakakibara et al. | |
| 8,401,450 | B2 | 3/2013 | Sekihara et al. | |
| 8,445,090 | B2 | 5/2013 | Nakajima et al. | |
| 8,626,046 | B2 | 1/2014 | Sekihara et al. | |
| 8,755,726 | B2 | 6/2014 | Sugimoto | |
| 2012/0294659 | A1* | 11/2012 | Lee et al. | 399/329 |
| 2014/0105659 | A1 | 4/2014 | Miyahara | |
| 2014/0133892 | A1 | 5/2014 | Miura et al. | |

FOREIGN PATENT DOCUMENTS

| | | | |
|---|---|---|---|
| JP | 2004-12649 | A | 1/2004 |
| JP | 2004-45851 | A | 2/2004 |
| JP | 2009-263405 | A | 11/2009 |
| JP | 2010-92008 | A | 4/2010 |
| JP | 2011-186127 | A | 9/2011 |
| JP | 2012-225986 | A | 11/2012 |
| WO | 2014/097616 | A1 | 6/2014 |
| WO | 2014/103263 | A1 | 7/2014 |
| WO | 2014/112358 | A1 | 7/2014 |

OTHER PUBLICATIONS

International Preliminary Report on Patentability in International Application No. PCT/JP2013/007440 (issued Jun. 30, 2015).

* cited by examiner

ELECTROPHOTOGRAPHIC FIXING MEMBER, FIXING APPARATUS AND ELECTROPHOTOGRAPHIC IMAGE FORMING APPARATUS

CROSS-REFERENCE TO RELATED APPLICATIONS

This application is a continuation of International Application No. PCT/JP2013/007440, filed Dec. 18, 2013, which claims the benefit of Japanese Patent Applications No. 2012-282976, filed Dec. 26, 2012 and No. 2013-251804, filed Dec. 5, 2013.

BACKGROUND OF THE INVENTION

1. Field of the Invention

The present invention relates to an electrophotographic fixing member. The present invention also relates to a fixing apparatus and an electrophotographic image forming apparatus using the member.

2. Description of the Related Art

In general, in a heat-fixing apparatus for use in an electrophotographic system such as a laser printer or a copier, rotation members such as a pair of a heated roller and a roller, a film and a roller, a belt and a roller, and a belt and a belt are in pressure-contact with each other.

Then, a material to be recorded, which holds an image by an unfixed toner, is introduced to a pressure-contact portion (fixing nip) formed between the rotation members, and heated, and thus the toner is molten to fix the image to the material to be recorded such as paper.

The rotation member with which the unfixed toner image held on the material to be recorded is in contact is referred to as a fixing member, and is called a fixing roller, a fixing film or a fixing belt depending on the form thereof.

As such fixing members, those having the following configuration are known.

A configuration in which a substrate formed of a metal, a heat resistant resin or the like is covered with a silicone rubber elastic layer having heat resistance and a releasing layer made of a fluororesin, the layers sandwiching a silicone rubber adhesive therebetween.

A configuration in which a releasing layer is formed by forming a coat of a coating material including a fluororesin on a silicone rubber elastic layer and firing the coat at a temperature equal to or higher than the melting point of the fluororesin.

The fixing member having such a configuration can enclose and melt a toner image in the fixing nip without excessively compressing the toner image, with the use of an excellent elastic deformation of the silicone rubber elastic layer. Therefore, the fixing member has an effect of preventing image displacement and bleeding, and improving color mixing in particular when fixing a color image of multicolor construction. The fixing member also has an effect of following the irregularities of fibers of paper as the material to be recorded, to prevent the occurrence of melting unevenness of toner.

Furthermore, the function of the fixing member is demanded to supply to a material to be recorded a sufficient amount of heat for instantaneously melting a toner in a fixing nip portion.

Against such a problem, a configuration in Japanese Patent Application Laid-Open No. 2004-45851 is known in which a high heat capacity material is incorporated to a part of a fixing member to allow the fixing member to ensure a high heat capacity, resulting in the increase in amount of heat supplied to the material to be recorded. Since a larger amount of heat can be thus stored in the fixing member, the configuration is considered to be effective for electric power saving and an increase in speed.

In addition, in Japanese Patent Application Laid-Open No. 2010-92008, a fixing belt has been proposed in which carbon nanotubes and a filler are contained in an elastic layer to thereby improve the heat conductivity of the elastic layer. The amount of the filler compounded in the elastic layer and the amount of the carbon nanotubes compounded in the elastic layer are controlled to thereby enable the enhancements in heat conductivity and resiliency.

SUMMARY OF THE INVENTION

Meanwhile, as described above, in a fixing process, thermal energy is supplied to the material to be recorded and a toner in the fixing nip portion formed between the fixing member that is in contact with the unfixed toner and a pressure member that oppositely abuts on the fixing member. A toner is thus molten, passes through the fixing nip and is then cooled and solidified, and therefore the toner is fixed on the material to be recorded to form a fixing image. As higher speed and smaller size have been recently demanded in a heat-fixing apparatus, a time for passing through the fixing nip (dwell time) is shortened, and thus it is necessary to supply heat to the material to be recorded and the toner in a shorter period of time.

The present inventors have discussed heat supply from the fixing member to the material to be recorded, and have thought that it is effective to introduce the concept of thermal effusivity to the ability of a high temperature material to supply heat to a low temperature material. That is, the thermal effusivity is used as an index of an ability to give heat or draw heat when a material is brought into contact with an article having a different temperature. Such thermal effusivity b is expressed by the following expression (1'):

$$b=(\lambda \cdot C_p \cdot \rho)^{0.5} \quad (1')$$

wherein $\lambda$ denotes heat conductivity, $C_p$ denotes specific heat at constant pressure and $\rho$ denotes density. In addition, $C_p \cdot \rho$ denotes heat capacity per unit volume (=volume heat capacity). A higher thermal effusivity exhibits a higher ability to supply heat, and a lower thermal effusivity exhibits a lower ability to supply heat. In the fixing member, in order to give thermal energy to the material to be recorded and the toner in a shorter dwell time, it is necessary to design higher thermal effusivity from the viewpoint of the enhancement in ability to supply heat. Therefore, both of heat conductivity and volume heat capacity are required to be simultaneously enhanced without being sacrificed.

Meanwhile, along with the diversification in use environment of a user, various types of paper are used for the paper for use as the material to be recorded, and the ability of the fixing member to supply heat is also required to deal with the various types of paper. In particular, it is considered that the case, where paper having larger irregularities like recycled paper having a high rate of used paper blended is used, has a disadvantage of large irregularities on the surface thereof also from the viewpoint of heat supply.

When contact heat transfer between two materials is considered, it is known that the surface roughness of a contacting surface, the pressing pressure, the hardness of a contacting material and the like largely act as factors that have an influence on the heat transfer (DENNETSU KOGAKU SHIRYO (Heat Transfer Engineering Information), fourth edition, by the Japan Society of Mechanical Engineers, page 30). However, when the pressing pressure of a fixing apparatus is designed to be higher, a torque necessary for rotating the fixing apparatus is increased to result in the increase in size of the apparatus. In addition, a toner image formed on a convex portion is excessively compressed to thereby cause the bleeding of the image and the reduction in dot reproducibility. Therefore, it is necessary to make the contacting material, namely, the fixing member flexible.

In order to sufficiently melt and color a toner present particularly in a concave portion of paper, the surface of the fixing member is required to follow irregularities of the paper when the paper passes through a fixing nip portion. The surface of the fixing member follows the irregularities and thus is directly brought into contact with the toner in a concave portion to enable heat to be transferred, providing an effect of preventing melting unevenness of the toner from occurring. In order to achieve such an effect, it is necessary to design the elastic layer so as to have a lower hardness, thereby ensuring flexibility.

As described above, the ability of the fixing member to supply heat can be enhanced by designing the thermal effusivity of the elastic layer, namely, the heat conductivity and the volume heat capacity to be higher. Such thermophysical properties can be enhanced by increasing the content of the filler in the elastic layer. However, the increase in the amount of the filler added in such a region also causes the increase in the hardness of the elastic layer. Conventionally, the content of the filler in the elastic layer has been appropriately adjusted depending on properties of the filler contained in the elastic layer in order to suppress the increase in the hardness of the fixing member. However, in consideration of further higher speed and further smaller size of an electrophotographic image forming process in the future as well as the diversification in use environment, a configuration that can solve the two conflicting problems at a further higher level than conventional one is required.

In Japanese Patent Application Laid-Open No. 2010-92008 above, a fixing belt has been proposed in which, when the volume percent of the filler and the volume percent of the carbon nanotubes in the elastic layer are expressed by X and Y, respectively, $10X+3Y<750$, $3X+30Y>170$, and $Y>0.1$ are satisfied.

FIG. 10 illustrates an area defined by the expressions in a graph in which the vertical axis indicates Y % and the horizontal axis indicates X %. Then, the invention according to Japanese Patent Application Laid-Open No. 2010-92008 is directed to control the amounts of the filler and the carbon nanotubes added, thereby simultaneously achieving the suppression of the increase in hardness and the enhancement in heat conductivity.

Meanwhile, the present inventors have made studies based on the disclosure of Japanese Patent Application Laid-Open No. 2010-92008, and have found that the fixing member whose heat conductivity is designed to be higher has the problem that the following property to irregularities of paper, namely, flexibility is impaired.

In addition, the present inventors have made further studies, and as a result, have concluded that in order to impart sufficient flexibility to the fixing member, the amounts of the filler and the carbon nanotubes compounded in the elastic layer are required to satisfy $3X+30Y<170$, namely, to fall within a shaded area in FIG. 10.

That is, in order to obtain a fixing member having a good heat conductivity while ensuring flexibility, it is necessary to allow the amounts of the filler and the carbon nanotubes compounded in the elastic layer to fall within a shaded area in FIG. 10 and at the same time to enhance heat-conducting performance.

Then, the present invention is directed to providing a fixing member having an elastic layer that is flexible and that has high thermal effusivity.

Further, the present invention is directed to providing a fixing apparatus that can favorably fix a toner even to a member to be recorded having low smoothness and large irregularities, and an electrophotographic image forming apparatus.

The present inventors have intensively made studies in order to simultaneously realize flexibility and a high heat-conducting performance in a fixing member at a higher level. As a result, the present inventors have found that a fixing member having an elastic layer that ensures high thermal effusivity and flexibility, which would not have been achieved by a conventional configuration, is obtained. The present invention is based on such a finding and solves the problem by the following measure.

According to one aspect of the present invention, there is provided an electrophotographic fixing member comprising: a substrate, an elastic layer and a releasing layer, wherein the elastic layer contains a silicone rubber, an inorganic filler and a vapor grown carbon fiber, wherein: when a volume percent of the inorganic filler compounded in the elastic layer is expressed by X (%) and a volume percent of the vapor grown carbon fibers compounded in the elastic layer is expressed by Y (%), the following expression (1), expression (2) and expression (3) are satisfied, and wherein: the vapor grown carbon fiber has an aspect ratio of 50 or more, the aspect ratio being a ratio of a fiber length to a fiber diameter:

$$3X+30Y\leq 170 \quad (1)$$

$$25\leq X\leq 50 \quad (2)$$

$$0.5\leq Y\leq 3.1 \quad (3).$$

According to another aspect of the present invention, there is provided a fixing apparatus including the fixing member, and a heating unit of the fixing member.

According to further aspect of the present invention, there is provided an electrophotographic image forming apparatus including the above-described fixing apparatus.

The present invention can achieve a fixing member that includes an elastic layer having high thermal effusivity while ensuring the following property of the surface of the member to a material to be recorded having large irregularities like recycled paper.

The present invention can also achieve a fixing apparatus that can stably impart sufficient heat to a toner and a material to be recorded while suppressing melting unevenness of a toner.

The present invention can further achieve an electrophotographic image forming apparatus that can stably provide a high-definition image to various materials to be recorded.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The fixing member according to the present invention is described below based on a specific configuration.

(1) Schematic Configuration of Fixing Member

The detail of the present invention is described using the drawings.

Figure 1:
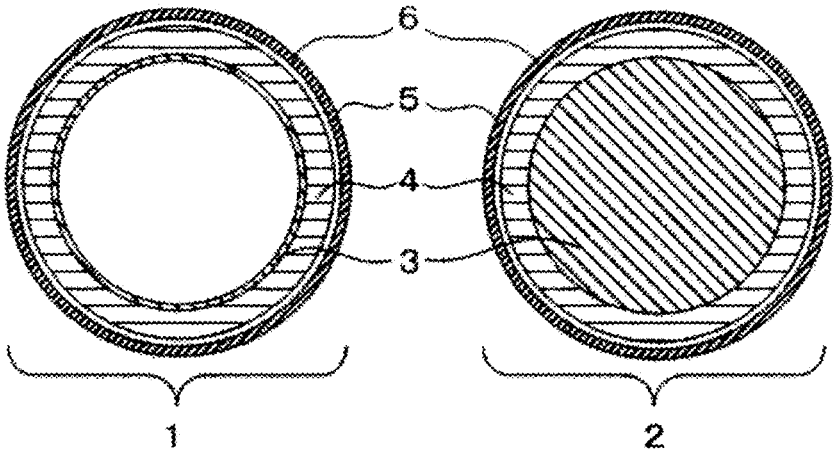
FIG. 1 is a schematic transverse cross-sectional view of the fixing member according to the present invention.

FIG. 1 is a schematic transverse cross-sectional view illustrating one aspect of the electrophotographic fixing member according to the present invention, and reference numeral 1 denotes a fixing member having a belt shape (fixing belt) and reference numeral 2 denotes a roller-shaped fixing member (fixing roller). In general, the fixing member is called a fixing belt in the case where a substrate itself is deformed to thereby form a fixing nip, and is called a fixing roller in the case where a substrate itself is hardly deformed and a fixing nip is formed by elastic deformation of an elastic layer.

In FIG. 1, reference numeral 3 denotes a substrate, reference numeral 4 denotes an elastic layer that covers the periphery of the substrate 3, and reference numeral 6 denotes a releasing layer. The releasing layer 6 may be secured to the periphery of the elastic layer 4 by an adhesive layer 5.

Figure 2:
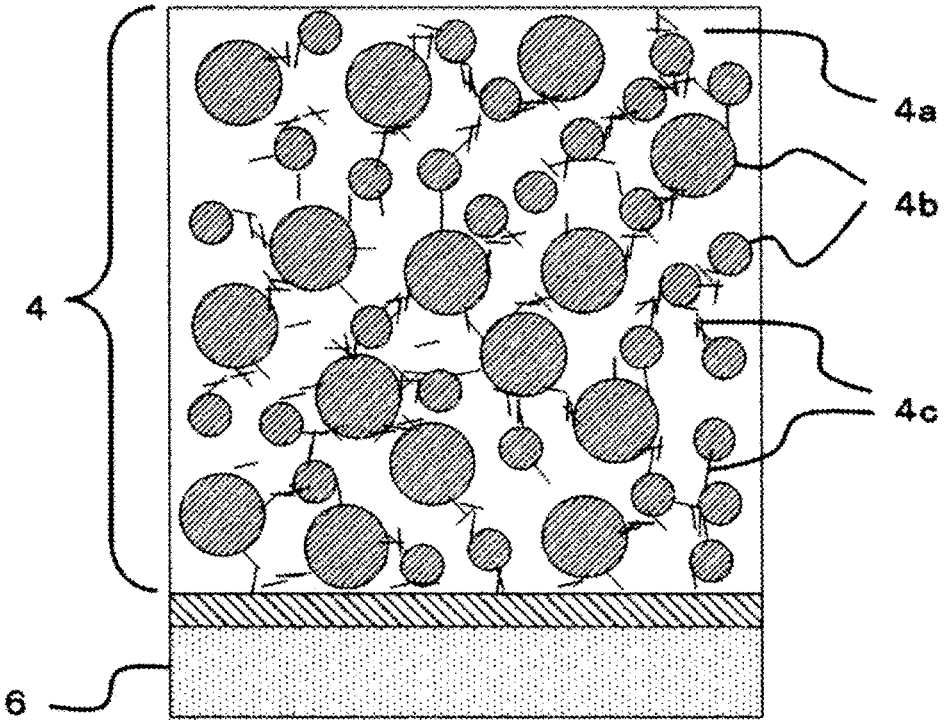
FIG. 2 is a schematic cross-sectional view near the surface of the fixing member according to the present invention.

In addition, FIG. 2 is a view schematically representing an enlarged cross-section of a layer configuration near the surface of the fixing member. In FIG. 2, reference numeral 4 denotes an elastic layer, reference character 4*a* denotes a silicone rubber as a base material, reference character 4*b* denotes an inorganic filler, and reference character 4*c* denotes a vapor grown carbon fiber. Such respective components constituting the elastic layer are described later in detail.

As illustrated in FIG. 2, the vapor grown carbon fiber 4*c* entwined with one another are present in the elastic layer 4 in the form of bridge between the inorganic filler 4*b*. In the fixing member according to the present invention, it is considered that the inorganic filler 4*b* is thus bridged by the vapor grown carbon fiber 4*c* to thereby form a heat conducting path. Therefore, a fixing member having an excellent ability to supply heat can be obtained while the total amount (volume percent) of the filler added, which increases the heat conduction and the hardness, is suppressed and an excessive increase in hardness is not caused.

Reference numeral 5 denotes an adhesive layer and reference numeral 6 denotes a releasing layer. The methods for forming the layers are also described later in detail.

Hereinafter, each of the layers in the fixing member will be described and the utilizing method thereof will be described.

(2) Substrate

As the substrate 3, for example, a metal or an alloy such as aluminum, iron, stainless or nickel, or a heat resistant resin such as polyimide is used.

When the fixing member has a roller shape, a core is used for the substrate 3. Examples of the material of the core include metals and alloys such as aluminum, iron and stainless. The core may have a hollow interior portion, as long as the core has such a strength that withstands pressure in a fixing apparatus. In addition, when the core has a hollow shape, the interior thereof can also be provided with a heat source.

When the fixing member has a belt shape, examples of the substrate 3 include a nickel-plated sleeve and a stainless sleeve, and a heat resistant resin belt made of polyimide or the like. The interior surface of the belt may be further provided with a layer (not illustrated) for imparting functions such as wear resistance and heat insulating property. The exterior surface thereof may be further provided with a layer (not illustrated) for imparting functions such as adhesiveness.

(3) Elastic Layer and Method for Producing Same

The elastic layer 4 functions as a layer that allows the fixing member to carry such elasticity with flexibility that allows the fixing member to follow the irregularities of fibers of paper without compressing a toner at the time of fixing.

In order to exert such a function, a heat resistant rubber such as a silicone rubber or a fluororubber can be used, and in particular a product obtained by curing an addition-curable silicone rubber can be used as a base material in the elastic layer 4.

(3-1) Addition-Curable Silicone Rubber

In FIG. 2, the silicone rubber 4*a* is made of an addition-curable silicone rubber.

In general, an addition-curable silicone rubber includes an organopolysiloxane having an unsaturated aliphatic group, an organopolysiloxane having active hydrogen connected to silicon, and a platinum compound as a crosslinking catalyst.

Examples of the organopolysiloxane having an unsaturated aliphatic group include the following:

- linear organopolysiloxane in which both ends of a molecule are each represented by $(R^1)_2R^2SiO_{1/2}$, and intermediate units of a molecule are represented by $(R^1)_2SiO$ and $R^1R^2SiO$; and
- branched organopolysiloxane in which intermediate units include $R^1SiO_{3/2}$ or $SiO_{4/2}$.

Herein, each $R^1$ represents a monovalent unsubstituted or substituted hydrocarbon group connected to a silicon atom and not including an aliphatic unsaturated group. Specific examples include the following:

- alkyl groups (for example, methyl group, ethyl group, propyl group, butyl group, pentyl group and hexyl group);
- aryl groups (phenyl group and the like); and
- substituted hydrocarbon groups (for example, chloromethyl group, 3-chloropropyl group, 3,3,3-trifluoropropyl group, 3-cyanopropyl group and 3-methoxypropyl group).

In particular, from the viewpoints of allowing synthesis and handling to be easy and achieving an excellent heat resistance, 50% or more of $R^1$ (s) preferably represent a methyl group, and all of $R^1$ (s) particularly preferably represent a methyl group.

In addition, each $R^2$ represents an unsaturated aliphatic group connected to a silicon atom, examples thereof include vinyl group, allyl group, 3-butenyl group, 4-pentenyl group and 5-hexenyl group, and each $R^2$ can be vinyl group from the viewpoints of allowing synthesis and handling to be easy, and also easily performing a crosslinking reaction.

In addition, the organopolysiloxane having active hydrogen connected to silicon is a crosslinking agent that reacts with an alkenyl group in the organopolysiloxane component having an unsaturated aliphatic group by a catalytic action of the platinum compound to form a crosslinking structure.

The number of hydrogen atoms connected to a silicon atom is a number of more than 3 in average in one molecule. Examples of an organic group connected to a silicon atom include an unsubstituted or substituted monovalent hydrocarbon group having the same meaning as $R^1$ in the organopolysiloxane component having an unsaturated aliphatic group. In particular, the organic group can be a methyl group because of being easily synthesized and handled.

The molecular weight of the organopolysiloxane having active hydrogen connected to silicon is not particularly limited.

In addition, the viscosity of the organopolysiloxane at 25° C. is preferably in a range of 10 $mm^2/s$ or more and 100,000 $mm^2/s$ or less, and more preferably 15 $mm^2/s$ or more and 1,000 $mm^2/s$ or less. The reasons why the viscosity is limited to the ranges are because no case occurs in which the organopolysiloxane volatilizes during storage not to provide the desired degree of crosslinking and the desired physical properties of a formed product, and the organopolysiloxane can be easily synthesized and handled, and easily dispersed in a system uniformly.

Any of linear, branched and cyclic siloxane backbones may be adopted and a mixture thereof may be adopted. In particular, a linear siloxane backbone can be adopted because of allowing synthesis to be easy. A Si—H bond may be present in any siloxane unit in a molecule, but at least a part thereof can be partially present in a siloxane unit at an end of a molecule, like an $(R^1)_2HSiO_{1/2}$ unit.

As the addition-curable silicone rubber, one having an amount of an unsaturated aliphatic group of 0.1% by mol or more and 2.0% by mol or less based on 1 mol of a silicon atom can be adopted. In particular, the amount can be in a range of 0.2% by mol or more and 1.0% by mol or less.

(3-2) About Filler

The elastic layer 4 includes a filler for enhancing the heat conducting characteristic of the fixing member, and imparting reinforcing property, heat resistance, processability, conductivity and the like. Then, the elastic layer according to the present invention includes an inorganic filler and a vapor grown carbon fiber as the fillers.

(3-2-1) Inorganic Filler

In order to enhance the heat conducting characteristic of the elastic layer, the inorganic filler can be one having a high heat conductivity and a high volume heat capacity. Specifically, examples can include inorganics, in particular, metal and a metal compound.

Specific examples of the inorganic filler to be used for the purpose of enhancing the heat conducting characteristic include the followings. Herein, the followings can be used singly or as a mixture of two or more thereof.

silicon carbide; silicon nitride; boron nitride; aluminum nitride; alumina; zinc oxide; magnesium oxide; silica; copper; aluminum; silver; iron; nickel; metal silicon, or the like.

In particular, in order to enhance the heat capacity of the elastic layer, an inorganic filler having a volume heat capacity of 3.0 [$mJ/m^3 \cdot K$] or more is suitably used. Specific examples of such an inorganic filler include a filler containing alumina, magnesium oxide, zinc oxide, iron, copper or nickel as a main component. The volume heat capacities of such components are shown below:

alumina: 3.03 [$mJ/m^3 \cdot K$],
magnesium oxide: 3.24 [$mJ/m^3 \cdot K$],
zinc oxide: 3.02 [$mJ/m^3 \cdot K$],
iron: 3.48 [$mJ/m^3 \cdot K$],
copper: 3.43 [$mJ/m^3 \cdot K$], and
nickel: 3.98 [$mJ/m^3 \cdot K$].

The average particle diameter of the inorganic filler listed above is preferably 1 to 50 μm, and particularly preferably 5 to 30 μm, from the viewpoint of dispersibility in a material mixture for elastic layer formation.

Herein, the average particle diameter of the inorganic filler in the elastic layer is determined by a flow type particle image analyzing apparatus (trade name: FPIA-3000; manufactured by Sysmex Corporation). Specifically, a sample cut out from the elastic layer is placed in a porcelain crucible, and heated to 1000° C. in a nitrogen atmosphere to ash the rubber component for removal. The inorganic filler and vapor grown carbon fiber included in the sample are present in the crucible at the stage. Then, the crucible is heated to 1000° C. under an air atmosphere to burn the vapor grown carbon fibers. As a result, only the inorganic filler included in the sample remains in the crucible. The inorganic filler in the crucible is ground using a mortar and a pestle so as to provide primary particles, and then the primary particles are dispersed in water to prepare a specimen liquid. The specimen liquid is charged to the flow type particle image analyzing apparatus, and is introduced into an imaging cell in the apparatus and allowed to pass through the cell to shoot the inorganic filler as a static image.

The diameter of a circle (hereinafter, also referred to as "equal area circle") having the same area as the area of a particle image planar projected (hereinafter, also referred to as "particle projection image") of the inorganic filler is defined as the diameter of the inorganic filler according to the particle image. Then, the equal area circles of 1000 particles of the inorganic filler are determined, and the arithmetic average value thereof is defined as the average particle diameter of the inorganic filler.

In addition, as the inorganic filler, one having a spherical shape, a pulverized shape, a needle shape, a plate shape, a whisker shape or the like is used. In particular, an inorganic filler having such a shape as to allow a contact area with the elastic layer in the elastic layer to be relatively reduced is particularly suitably used from the viewpoint of dispersibility in a material mixture for elastic layer formation and for the purpose of suppressing the increase in hardness due to the addition of the filler to the elastic layer. Specific examples of the inorganic filler having such a shape include a spherical inorganic filler. More specifically, an inorganic filler is suitably used in which when a ratio [(Lmax)/(Lmin)] of the maximum length (Lmax) to the minimum length (Lmin) in the projection image of each of arbitrarily selected 1000 inorganic filler particles is determined, the arithmetic average value is 1 to 2. It is to be noted that when the projection image of a particle is a true circle, Lmax=Lmin is satisfied and the ratio is 1. For example, the arithmetic average value of the (Lmax)/(Lmin) of 1000 high-purity truly spherical alumina (trade name: Alunabeads CB-A25BC) particles used in Examples described later was 1.1.

(3-2-2) Vapor Grown Carbon Fiber

The elastic layer 4 further contains vapor grown carbon fiber as the filler, in addition to the inorganic filler, from the viewpoint of ensuring heat conductivity.

In FIG. 2, reference character 4*c* denotes the vapor grown carbon fiber.

The vapor grown carbon fiber is obtained by subjecting hydrocarbon and hydrogen as raw materials to a pyrolysis reaction in a gas phase in a heating furnace and growing the resultant to fibers by using catalyst fine particles as nuclei. The fiber diameter and the fiber length are controlled by the types, sizes and compositions of the raw materials and the catalyst, as well as the reaction temperature, atmospheric pressure and time, and the like, and fibers having a graphite structure further developed by a heat treatment after the reaction are known. The fibers have a plural-layer structure in the diameter direction, and have a shape in which graphite structures are stacked in the tubular form. The fibers generally have an average fiber diameter of 80 to 200 nm and an average fiber length of 5 to 15 μm.

Herein, the average fiber diameter and the average fiber length of the vapor grown carbon fiber in the elastic layer is determined by the following method.

That is, a predetermined amount (for example, about 10 g) of a sample is cut out from the elastic layer by using a razor or the like. The sample is placed in a porcelain crucible, and heated under a nitrogen atmosphere at 600° C. for 1 hour to ash organic substance components such as a resin and a rubber in the elastic layer for removal. The carbon fibers remain as the residue component in the crucible without being decomposed by firing under a nitrogen atmosphere.

One thousand fibers were randomly selected from the vapor grown carbon fibers in the residue component and observed at a magnification of ×30000 using a scanning electron microscope (trade name: JSM-5910V, manufactured by Jeol Ltd.) to measure the fiber lengths and the fiber diameters at fiber ends of the selected fibers by using digital image analysis software (trade name: Quick Grain Standard, manufactured by Innotech Corporation). Then, the arithmetic average values of the fiber lengths and the fiber diameters of the respective vapor grown carbon fibers are defined as an average fiber length and an average fiber diameter.

The vapor grown carbon fiber has a very high heat conductivity of about 1200 W/(m·K) in the longitudinal direction of the fiber. Therefore, bridging between the inorganic fillers in the elastic layer can allow a heat flow channel to be effectively formed in the elastic layer. Thus, the heat conductivity of the elastic layer as a whole can be drastically enhanced while the amount of the filler in the elastic layer is reduced.

Herein, when the vapor grown carbon fiber is added to the elastic layer in a large amount, the hardness of the elastic layer is increased.

On the other hand, it is difficult to sufficiently construct a bridging structure between the inorganic fillers by the vapor grown carbon fiber having an aspect ratio of less than 50. As a result, the vapor grown carbon fiber is required to be added in a large amount in order to ensure heat conductivity, thereby causing the increase in the hardness of the elastic layer.

Then, as the vapor grown carbon fiber according to the present invention, vapor grown carbon fiber having an aspect ratio of a fiber length to a fiber diameter (fiber length/fiber diameter) of 50 or more is used. Thus, the heat conductivity of the elastic layer can be effectively enhanced while the content of the vapor grown carbon fiber in the elastic layer is suppressed in such a range as not to significantly increase the hardness of the elastic layer.

The upper limit of the aspect ratio of the vapor grown carbon fiber is not particularly limited, but is about 500 in terms of limitations in production of the vapor grown carbon fiber. In addition, the upper limit is about 100 in terms of a range such that the vapor grown carbon fiber can be stably produced and supplied. Accordingly, the aspect ratio of the vapor grown carbon fiber according to the present invention can be 50 or more and 100 or less.

Then, such vapor grown carbon fiber is commercially available as, for example, "VGCF" and "VGCF-S" (both are trade names, produced by Showa Denko K. K.). Herein, "VGCF" has an average fiber diameter of 150 nm, an average fiber length of 9 μm, and an aspect ratio of 60.

In addition, "VGCF-S" has an average fiber diameter of 100 nm, an average fiber length of 10 μm, and an aspect ratio of 100.

(3-2-3) Other Filler

As other filler, carbon black (C) or the like may be contained for the purpose of imparting characteristics such as conductivity.

(3-2-4) Content

With respect to the filler, when a volume percent of the inorganic filler compounded in the elastic layer is expressed by X (%) and a volume percent of the vapor grown carbon fiber compounded in the elastic layer is expressed by Y (%), X and Y satisfy the following expression (1) to thereby enable the flexibility of the elastic layer to be ensured without excessive addition of the filler.

$$3X+30Y\leq 170 \quad (1)$$

In addition, X satisfies the condition of the following expression (2) to thereby enable a constant volume heat capacity to be ensured in the elastic layer.

$$25\leq X\leq 50 \quad (2)$$

Furthermore, Y satisfies the condition of the following expression (3) while the aspect ratio of the vapor grown carbon fiber is 50 or more, to thereby enable the heat conductivity of the elastic layer to be ensured while the amount of the vapor grown carbon fiber added is suppressed.

$$0.5\leq Y\leq 3.1 \quad (3)$$

The elastic layer satisfying all the conditions of the expression (1), expression (2) and expression (3) can simultaneously achieve good heat conductivity and volume heat capacity while ensuring following property against irregularities of paper or flexibility, and can also effectively supply heat even to a toner image formed on a concave portion on the paper surface.

(3-2-5) Measurement Method of Volume Heat Capacity of Filler

The volume heat capacity of the filler can be determined by the product of a specific heat at constant pressure ($C_p$) and a true density (ρ), and each value can be determined by each of the following apparatuses.

Specific heat at constant pressure ($C_p$): differential scanning calorimeter (trade name: DSC823e; manufactured by Mettler-Toledo International Inc.)

Specifically, an aluminum pan is used as each of a sample pan and a reference pan. First, as a blank measurement, a measurement is performed which has a program in which both the pans are kept empty at a constant temperature of 15° C. for 10 minutes, then heated to 115° C. at a rate of temperature rise of 10° C./min, and then kept at a constant temperature of 115° C. for 10 minutes. Then, about 10 mg of a synthetic sapphire having known specific heat at constant pressure is used for a reference material, and subjected to a measurement by the same program. Then, about 10 mg of a measurement sample (filler) in the same amount as the amount of the reference sapphire is set to the sample pan, and subjected to a measurement by the same program. The measurement results are analyzed using specific heat analyzing software attached to the differential scanning calorimeter, and the specific heat at constant pressure ($C_p$) at 25° C. is calculated from the arithmetic average value of the measurement results for 5 times.

True density (ρ): Dry automatic densimeter (trade name: Accupyc 1330-01; manufactured by Shimadzu Corporation) Specifically, a 10 $cm^3$ specimen cell is used, and a sample (filler) is placed in the specimen cell in a volume of about 80% of the cell volume. After the weight of the sample is measured, the cell is set to a measurement portion in the apparatus and subjected to gas replacement using helium as a measurement gas 10 times, and then the volume is measured 10 times. The density (ρ) is calculated from the weight of the sample and the volume measured.

(3-3) Thickness of Elastic Layer

The thickness of the elastic layer can be appropriately designed from the viewpoints of contributing to the surface hardness of the fixing member and ensuring the nip width. When the fixing member has an endless belt shape, the elastic layer can be relatively thinned so that when being incorporated in a fixing apparatus, the fixing member can be deformed along with the pressure member to ensure a larger nip depth. Specifically, the thickness of the elastic layer is preferably 100 μm or more and 500 μm or less and particularly preferably 200 μm or more and 400 μm or less.

On the other hand, when the fixing member has a roller shape, the substrate can be rigid and the nip depth can be compensated by deformation of the elastic layer. Therefore, the thickness of the elastic layer is preferably in a range of 300 μm or more and 10 mm or less, and specifically 1 mm or more and 5 mm or less.

(3-4) Production Method of Elastic Layer

As the production method of the elastic layer, a mold forming method, and processing methods such as a blade coating method, a nozzle coating method and a ring coating method, in Japanese Patent Application Laid-Open No. 2001-62380, in Japanese Patent Application Laid-Open No. 2002-213432 and the like, are widely known. Any of such methods can be used to heat and crosslink an admixture carried on the substrate, thereby forming the elastic layer.

Figure 3:
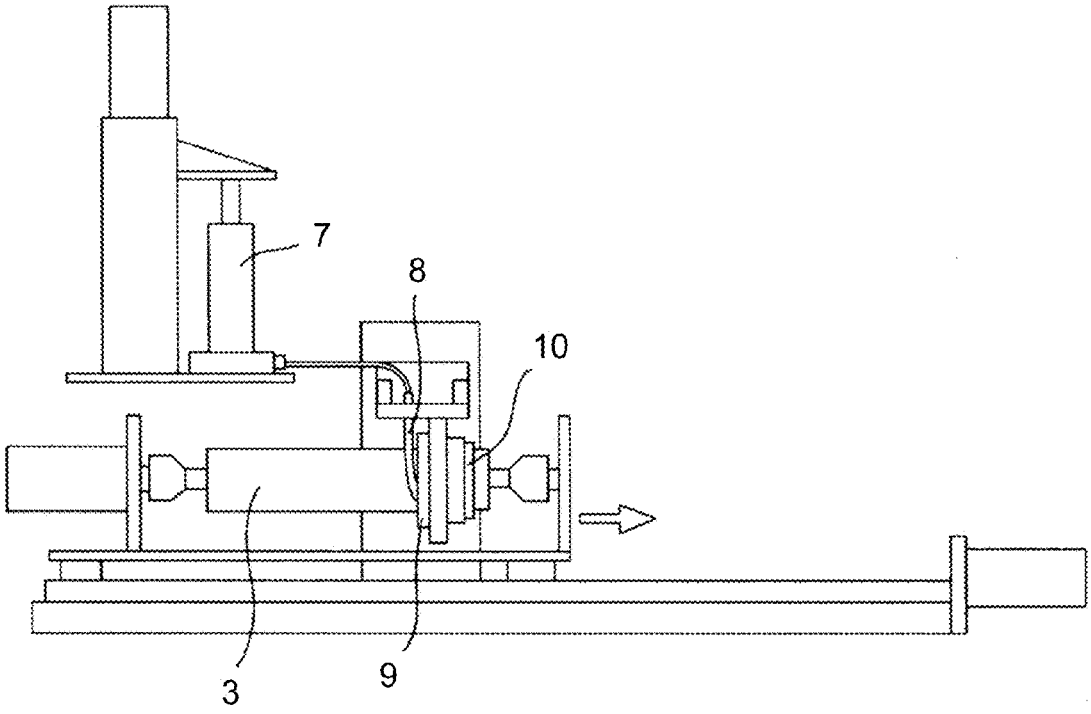
FIG. 3 is an illustrative view of one example of a step of forming an elastic layer of the fixing member according to the present invention.

FIG. 3 illustrates one example of a step of forming the elastic layer 4 on the substrate 3, and is a schematic view for describing a method using a so-called ring coating method.

Each filler is weighed, and compounded in an uncrosslinked base material (in the present example, addition-curable silicone rubber), the resultant is sufficiently mixed and defoamed using a planetary universal mixer or the like to provide a raw material admixture for elastic layer formation, and the raw material admixture is filled in a cylinder pump 7 and pressure-fed to be applied to the periphery of the substrate 3 from a coating head 9 through a supply nozzle 8 of the raw material admixture.

The substrate 3 is allowed to move toward the right direction of the drawing at a predetermined speed at the same time as the application, thereby enabling a coat 10 of the raw material admixture to be formed on the periphery of the substrate 3.

The thickness of the coat can be controlled by a clearance between the coating head 9 and the substrate 3, the supply speed of the raw material admixture, the movement speed of the substrate 3, and the like.

The coat 10 of the raw material admixture, formed on the substrate 3, is heated by a heating unit such as an electric furnace for a given period of time to allow a crosslinking reaction to progress, thereby enabling the elastic layer 4 to be formed.

(4) Releasing Layer and Production Method of Same

As the releasing layer 6, mainly a fluororesin, for example, exemplary resins listed below are used:

tetrafluoroethylene-perfluoro(alkyl vinyl ether) copolymer (PFA), polytetrafluoroethylene (PTFE), tetrafluoroethylene-hexafluoropropylene copolymer (FEP) or the like.

Among the exemplary materials listed above, PFA can be used from the viewpoints of formability and toner releasing property.

The forming measure is not particularly limited, but a method for covering with a tubular formed article, a method including coating the surface of the elastic layer with fluororesin fine particles directly or with a coating material having fluororesin fine particles dispersed in a solvent, and drying and melting the resultant for baking, and the like are known.

The thickness of the fluororesin releasing layer is preferably 10 μm or more and 50 μm or less and further preferably 30 μm or less, and can be designed to be a thickness equal to or less than 10% of the thickness of the elastic layer. The thickness within such a range enables maintaining the flexibility of the elastic layer stacked, suppressing the excessive increase in surface hardness of the fixing member.

(4-1) Releasing Layer Formation by Covering with Fluororesin Tube

A fluororesin tube can be prepared by a common method when a heat-melting fluororesin such as PFA is used. For example, a heat-melting fluororesin pellet is formed into a film by using an extrusion molding machine.

The inside of the fluororesin tube can be subjected to a sodium treatment, an excimer laser treatment, an ammonia treatment or the like in advance to thereby activate the surface and enhance adhesiveness.

Figure 4:
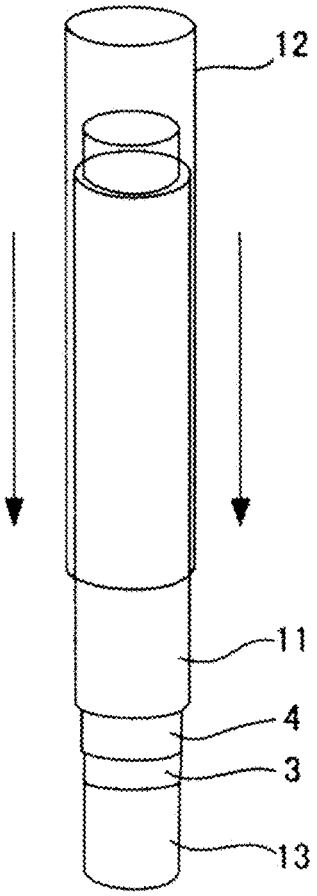
FIG. 4 is an illustrative view of one example of a step of forming a releasing layer of the fixing member according to the present invention.

FIG. 4 is a schematic view of one example of a step of stacking a fluororesin layer on the elastic layer 4 via an adhesive 11. The adhesive 11 is applied to the surface of the elastic layer 4 described above. The adhesive will be described later in detail. Before the application of the adhesive 11, the surface of the elastic layer 4 may also be subjected to an ultraviolet irradiation step. Thus, penetration of the adhesive 11 to the elastic layer 4 can be suppressed, and the increase in surface hardness due to the reaction of the adhesive 11 with the elastic layer can be suppressed. By performing the ultraviolet irradiation step under a heating environment not more than the heat-resistant temperature of the elastic layer, the step can be further effectively performed.

The outer surface of the adhesive 11 is covered with a fluororesin tube 12 as the releasing layer 6 for stacking. When the substrate 3 is a shape-retainable core, no core cylinder is required, but when a thin substrate such as a resin belt or a metal sleeve for use in the belt-shaped fixing member is used, the substrate is externally fitted to a core cylinder 13 and held in order to prevent deformation at the time of processing.

The covering method is not particularly limited, but a covering method in which an adhesive is used as a lubricant, or a covering method in which a fluororesin tube is expanded from the outside can be used.

After the covering, a unit not illustrated is used to squeeze out the excessive adhesive remaining between the elastic layer and the releasing layer for removal. After the squeezing out, the thickness of an adhesive layer can be 20 μm or less. If the thickness is more than 20 μm, the deterioration in heat conducting characteristic may be caused.

Then, the adhesive layer can be heated in a heating unit such as an electric furnace for a given period of time to thereby cure and bond the adhesive, and both ends thereof are if necessary processed so as to provide the desired length, thereby enabling to provide the fixing member of the present invention.

(4-1-1) Adhesive

The adhesive can be appropriately selected depending on the materials of the elastic layer and the releasing layer. However, when an addition-curable silicone rubber is used for the elastic layer, an addition-curable silicone rubber in which a self-adhesive component is compounded can be used as the adhesive 11. Specifically, the addition-curable silicone rubber contains an organopolysiloxane having an unsaturated hydrocarbon group typified by a vinyl group, hydrogen organopolysiloxane, and a platinum compound as a crosslinking catalyst. Then, the addition-curable silicone rubber is cured by an addition reaction. As such an adhesive, a known adhesive can be used.

Examples of the self-adhesive component include the following:

- silane having at least one, preferably two or more functional groups selected from the group consisting of an alkenyl group such as a vinyl group, a (meth)acryloxy group, a hydrosilyl group (SiH group), an epoxy group, an alkoxysilyl group, a carbonyl group and a phenyl group;
- organosilicon compound such as cyclic or linear siloxane having 2 or more and 30 or less silicon atoms, preferably 4 or more and 20 or less silicon atoms; and
- non-silicon (namely, containing no silicon atom in a molecule) organic compound optionally containing an oxygen atom in a molecule, which contains one or more and four or less, preferably one or more and two or less aromatic rings that are monovalent or higher and tetravalent or lower, preferably divalent or higher and tetravalent or lower, such as a phenylene structure, in one molecule, and contains at least one, preferably two or more and four or less functional groups that can contribute to a hydrosilylation addition reaction (for example, an alkenyl group and a (meth)acryloxy group) in one molecule.

The self-adhesive component can be used singly or in combination of two or more thereof.

A filler can be added to the adhesive from the viewpoints of viscosity adjustment and ensuring heat resistance, as long as the filler component falls within the spirit of the present invention.

Examples of the filler include the following:

silica, alumina, iron oxide, cerium oxide, cerium hydroxide, carbon black and the like.

Such an addition-curable silicone rubber adhesive is also commercially available and can be easily obtained.

(4-2) Releasing Layer Formation by Fluororesin Coating

For coating processing of the fluororesin as the releasing layer, a method such as an electrostatic coating method of fluororesin fine particles or spray coating of a fluororesin coating material can be used.

When an electrostatic coating method is used, electrostatic coating of fluororesin fine particles is first applied to the inner surface of a mold, and the mold is heated to a temperature equal to or higher than the melting point of the fluororesin, thereby forming a thin film of the fluororesin on the inner surface of the mold. Thereafter, the inner surface is subjected to an adhesive treatment and then a substrate is inserted, an elastic layer material is injected and cured between the substrate and the fluororesin, and then a molded article is released together with the fluororesin to enable to provide the fixing member of the present invention.

Figure 5:
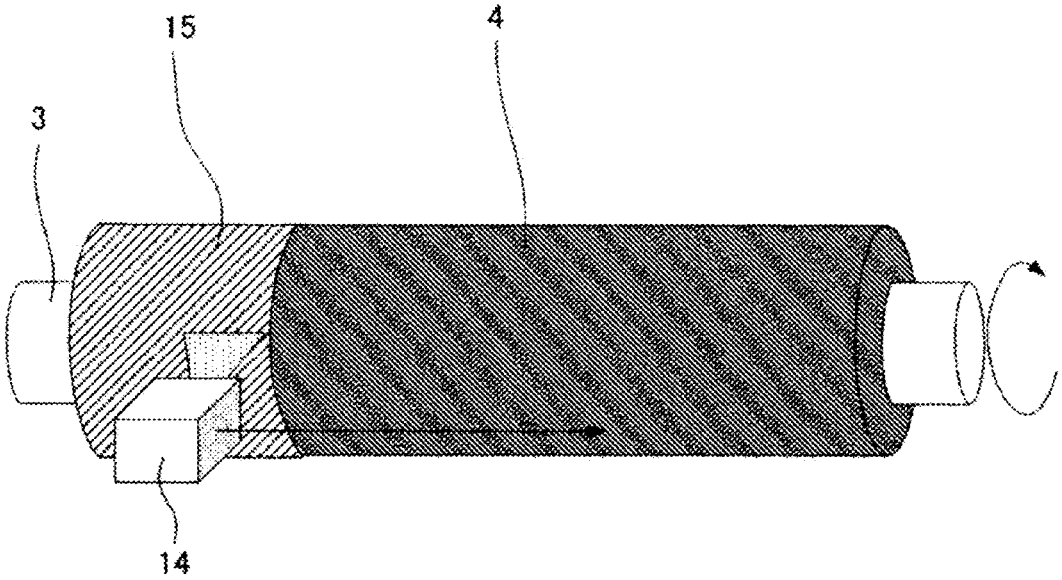
FIG. 5 is an illustrative view of one example of a step of forming a releasing layer of the fixing member according to the present invention.

When spray coating is used, a fluororesin coating material is used. FIG. 5 illustrates a schematic view of a spray coating method. The fluororesin coating material forms a so-called dispersion liquid in which fluororesin fine particles are dispersed in a solvent by a surfactant or the like. The fluororesin dispersion liquid is also commercially available and can be easily obtained. The dispersion liquid is supplied to a spray gun 14 by a unit non-illustrated, and misty sprayed by pressure of gas such as air. A member having the elastic layer 4 if necessary subjected to an adhesive treatment with a primer or the like is disposed at an opposite position to the spray gun, and the member is rotated at a given speed and the spray gun 14 is moved parallel with the axis direction of the substrate 3. Thus, a coat 15 of the fluororesin coating material can be evenly formed on the surface of the elastic layer. The member on which the coat 15 of the fluororesin coating material is thus formed is heated to a temperature equal to or higher than the melting point of the fluororesin coating material film by using a heating unit such as an electric furnace, thereby enabling a fluororesin releasing layer to be formed.

(5) Fixing Apparatus

In an electrophotographic heat-fixing apparatus, rotation members such as a pair of a heated roller and a roller, a film and a roller, a belt and a roller, and a belt and a belt are in pressure-contact with each other, and are appropriately selected in consideration of conditions such as the process speed and the size of the electrophotographic image forming apparatus as a whole.

In the fixing apparatus, a heated fixing member and a pressure member are in pressure-contact with each other to thereby form a fixing nip N, and a material to be recorded P serving as a member to be heated, on which an image is formed by an unfixed toner G, is conveyed through the fixing nip width N while being sandwiched. Thus, a toner image is heated and pressurized. As a result, the toner image is molten and colored, and then cooled to thereby be fixed on the material to be recorded.

From a relationship of the nip width N with the conveyance velocity V of the material to be recorded at the time, N/V can be used to calculate a dwell time T that is a time at which the material to be recorded is retained in the fixing nip.

A fixing apparatus in which a belt-shaped fixing member extending over two rollers is used is exemplified in Japanese Patent Application Laid-Open No. 2004-45851, and thus a fixing apparatus will be hereinafter described with reference to a specific example other than the fixing apparatus in Japanese Patent Application Laid-Open No. 2004-45851.

(5-1) Heat-Fixing Apparatus Using Belt-Shaped Fixing Member

Figure 6:
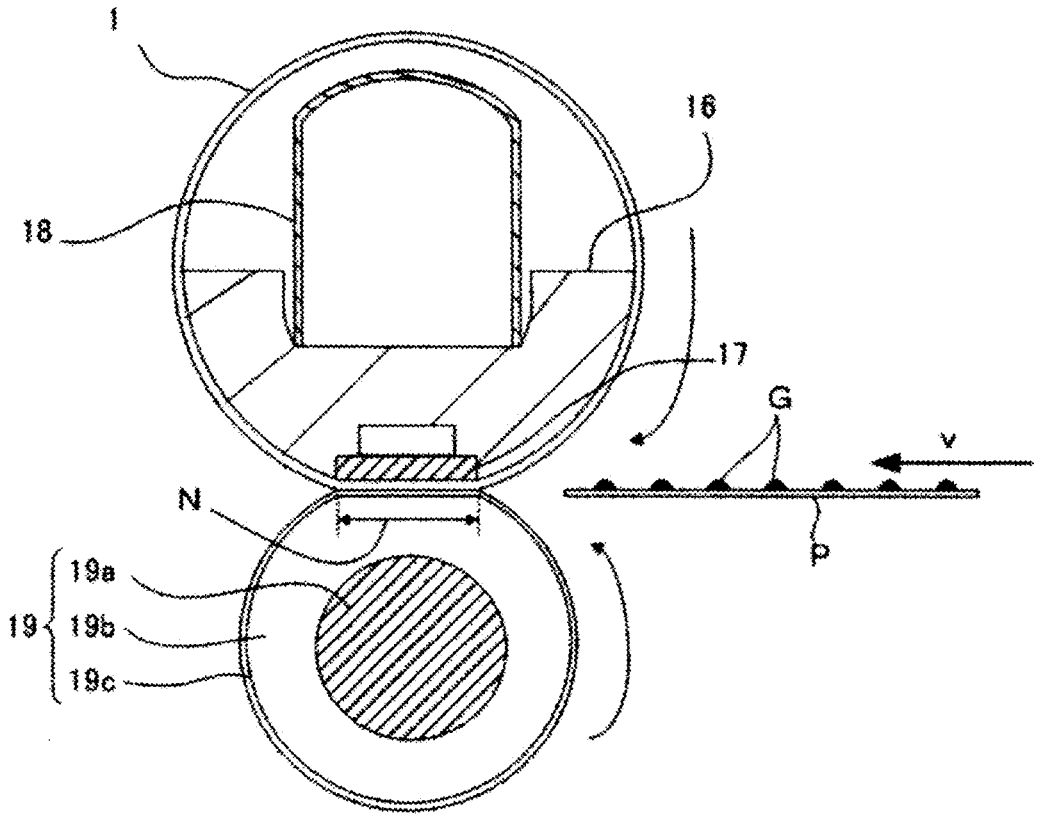
FIG. 6 is a cross-sectional view of one example of the fixing apparatus according to the present invention.

FIG. 6 illustrates a lateral cross-sectional schematic view of one example of a heat-fixing apparatus using the belt-shaped electrophotographic fixing member according to the present invention.

In the heat-fixing apparatus, reference numeral 1 denotes a seamless-shaped fixing belt, as a fixing member according to one embodiment of the present invention. In order to hold the fixing belt 1, a belt guide member 16 is formed which is shaped by a heat resistant and heat insulating resin.

A ceramic heater 17 as a heat source is provided at a position where the belt guide member 16 and the inner surface of the fixing belt 1 are in contact with each other.

The ceramic heater 17 is fitted in a groove portion shaped and provided along the longitudinal direction of the belt guide member 16, and immovably-supported. The ceramic heater 17 is electrified by a unit non-illustrated, to generate heat.

The seamless-shaped fixing belt 1 is externally fitted to the belt guide member 16 in a loose manner. A pressurizing rigid stay 18 is inserted in and passed through the inside of the belt guide member 16. An elastic pressure roller 19 as the pressure member is one in which an elastic layer 19*b* made of a silicone rubber is provided on a stainless core 19*a* to reduce surface hardness. Both ends of the core 19*a* are disposed while being rotatably held by bearing between plates (not illustrated) at the front side and at the back side as the chassis side against the apparatus. The elastic pressure roller 19 is covered with a fluororesin tube of 50 μm as a surface layer 19*c* in order to enhance surface property and releasing property. Each pressure spring (not illustrated) is compressed and disposed between each of both ends of the pressurizing rigid stay 18 and a spring holding member (not illustrated) at the chassis side of the apparatus to thereby impart a depressing force to the pressurizing rigid stay 18.

Thus, the lower surface of the ceramic heater 17 disposed on the lower surface of the belt guide member 16 and the upper surface of the pressure member 19 are in pressure-contact with each other while sandwiching the fixing belt 1, to form a predetermined fixing nip N. A material to be recorded P serving as a member to be heated, on which an image is formed by an unfixed toner G, is conveyed to the fixing nip N, while being sandwiched, at the conveyance velocity V. Thus, a toner image is heated and pressurized. As a result, the toner image is molten and colored, and then cooled to thereby be fixed on the material to be recorded.

(5-2) Heat-Fixing Apparatus Using Roller-Shaped Fixing Member

Figure 7:
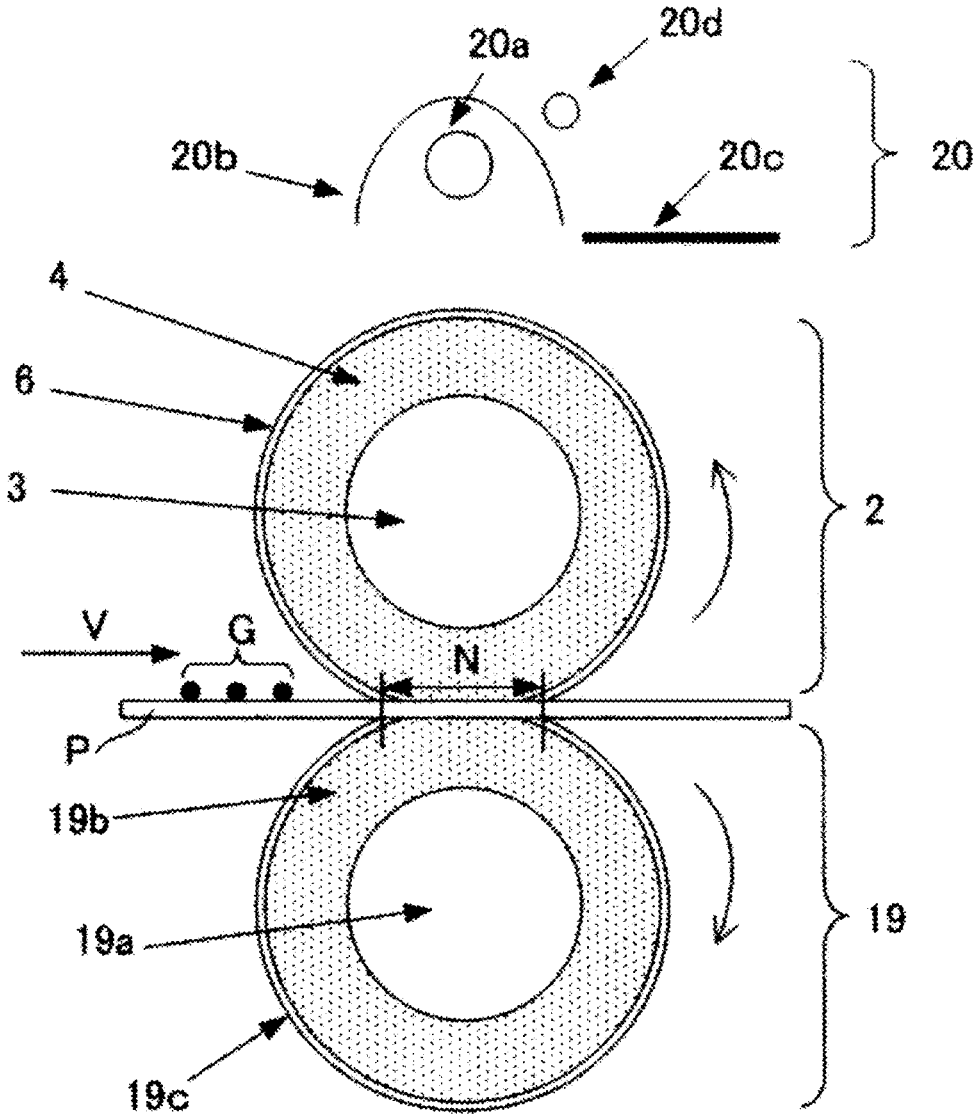
FIG. 7 is a cross-sectional view of one example of the fixing apparatus according to the present invention.

FIG. 7 illustrates a lateral cross-sectional schematic view of one example of a heat-fixing apparatus using the roller-shaped electrophotographic fixing member according to the present invention.

In the heat-fixing apparatus, reference numeral 2 denotes a fixing roller as a fixing member according to one embodiment of the present invention. In the fixing roller 2, an elastic layer 4 is formed on the outer periphery of a core 3 being a substrate, and a releasing layer 6 is further formed on the outer periphery of the elastic layer. A pressure roller 19 as the pressure member is oppositely disposed to the fixing roller 2, and the two rollers are rotatably pressed by a pressure unit non-illustrated, to thereby form a fixing nip N.

The external heating unit 20 heats the fixing roller 2 from the outside of the roller in a non-contact manner. The external heating unit 20 has a halogen heater (infrared source) 20*a* as a heat source, and a reflection mirror (infrared reflection member) 20*b* for effectively utilizing the radiation heat of the halogen heater 20*a*. The halogen heater 20*a* is oppositely arranged to the fixing roller 2, and is electrified by a unit non-illustrated, to generate heat. Thus, the surface of the fixing roller 2 is directly heated. In addition, the reflection mirror 20*b* having high reflectance is also disposed in a direction other than the direction of the fixing roller 2 by the halogen heater 20*a*. The reflection mirror 20*b* is provided, while being curved so as to project opposite to the fixing roller 2, so that the mirror receives the halogen heater 20*a* therein. Thus, the reflection mirror 20*b* can effectively reflect the radiation heat from the halogen heater 20*a* toward the fixing roller 2 without diffusing the radiation heat.

In the present embodiment, the reflection mirror 20*b* has a shape of an elliptical orbit in the paper-feeding direction, and is arranged so that one focal point is located near the halogen heater 20*a* and another focal point is located near the surface of the inside of the fixing roller 2. Thus, a light collection effect due to the elliptical shape can be utilized to collect reflected light in the vicinity of the surface of the fixing roller. In addition, a shutter 20*c* and a temperature detection element 20*d* as temperature control units of the fixing roller 2 are provided, and such temperature control units and the halogen heater 20*a* are appropriately controlled by a unit non-illustrated, to thereby enable the surface temperature of the fixing roller 2 to be controlled in a substantially uniform manner.

In the fixing roller 2 and the pressure roller 19, a rotation force is transmitted by a unit non-illustrated through ends of the substrate 3 or the core 19*a* to control rotation so that the movement speed of the surface of the fixing roller 2 is substantially the same as the conveyance velocity V of a member to be recorded. In the case, the rotation force is imparted to any one of the fixing roller 2 and the pressure roller 19 and another one may be driven to be rotated, or the rotation force may be imparted to both of the rollers.

A material to be recorded P serving as a member to be heated, on which an image is formed by an unfixed toner G, is conveyed to the fixing nip N thus formed of the heat-fixing apparatus while being sandwiched. Thus, a toner image is heated and pressurized. As a result, the toner image is molten and colored, and then cooled to thereby be fixed on the material to be recorded.

(6) Electrophotographic Image Forming Apparatus

Figure 8:
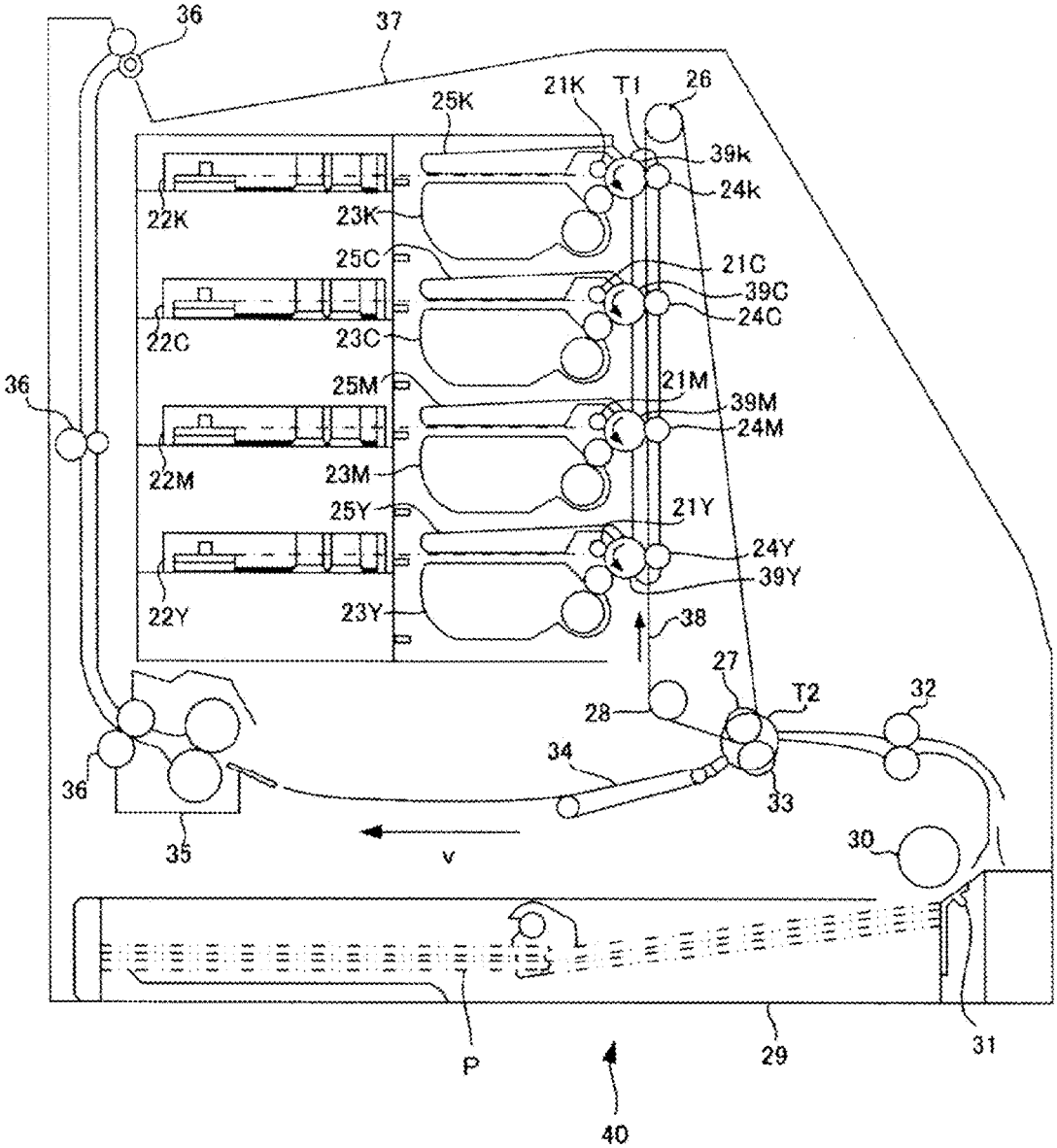
FIG. 8 is a cross-sectional view of one example of the electrophotographic image forming apparatus according to the present invention.

The entire configuration of the electrophotographic image forming apparatus is schematically described. FIG. 8 is a schematic cross-sectional view of a color laser printer according to the present embodiment.

A color laser printer (hereinafter, referred to as "printer") 40 illustrated in FIG. 8 has an image forming portion having an electrophotographic photosensitive drum (hereinafter, referred to as "photosensitive drum"), which is rotatable at a given speed, of each color of yellow (Y), magenta (M), cyan (C) and black (K). In addition, the printer has an intermediate transfer member 38 that retains a color image developed and multiple-transferred in the image forming portion and that further transfers the color image to a material to be recorded P fed from a feeding portion.

Photosensitive drums 39 (39Y, 39M, 39C, 39K) are rotatably driven by a driving unit (not illustrated) in a counter-clockwise manner as illustrated in FIG. 8.

The photosensitive drums 39 are provided with charging apparatuses 21 (21Y, 21M, 21C, 21K) for uniformly charging the surfaces of each of the photosensitive drums 39, scanner units 22 (22Y, 22M, 22C, 22K) for radiating a laser beam based on image information to form an electrostatic latent image on each of the photosensitive drums 39, developing units 23 (23Y, 23M, 23C, 23K) for attaching a toner to the electrostatic latent image to develop the latent image as a toner image, primary transfer rollers 24 (24Y, 24M, 24C, 24K) for transferring the toner image of each of the photosensitive drums 39 to the intermediate transfer member 38 by a primary transfer portion T1, and cleaning units 25 (25Y, 25M, 25C, 25K) having a cleaning blade to remove a transfer residue toner remaining on the surface of each of the photosensitive drums 39 after transfer, arranged on the circumferences thereof in this order in the rotation direction.

During image formation, a belt-shaped intermediate transfer member 38 extending over rollers 26, 27 and 28 is rotated, and the toner image of each color formed on each of the photosensitive drums is superimposed on the intermediate transfer member 38 and primary transferred to thereby form a color image.

The material to be recorded P is conveyed to a secondary transfer portion by a conveyance unit so as to be synchronized with the primary transferring to the intermediate transfer member 38. The conveyance unit has a feeding cassette 29 accommodating a plurality of the materials to be recorded P, a feeding roller 30, a separation pad 31 and a pair of resist rollers 32. During image formation, the feeding roller 30 is driven and rotated according to an image forming operation, and the materials to be recorded P in the feeding cassette 29 are separated one by one and conveyed to the secondary transfer portion by the pair of resist rollers 32 with being in time with the image forming operation.

A movable secondary transfer roller 33 is arranged in a secondary transfer portion T2. The secondary transfer roller 33 is movable in a substantially vertical direction. Then, the roller 33 is pressed on the intermediate transfer member 38 via the material to be recorded P at a predetermined pressure during image transferring. In the time, a bias is simultaneously applied to the secondary transfer roller 33 and the toner image on the intermediate transfer member 38 is transferred to the material to be recorded P.

Since the intermediate transfer member 38 and the secondary transfer roller 33 are separately driven, the material to be recorded P sandwiched therebetween is conveyed in a left arrow direction indicated in FIG. 8 at a predetermined conveyance velocity V, and further conveyed by a conveyance belt 34 to a fixing portion 35 as the next step. In the fixing portion 35, heat and pressure are applied to fix the transferred toner image to the material to be recorded P. The material to be recorded P is discharged on a discharge tray 37 on the upper surface of the apparatus by a pair of discharge rollers 36.

Then, the fixing apparatus according to the present invention illustrated in FIG. 6 or FIG. 7 can be applied to the fixing portion 35 of the electrophotographic image forming apparatus illustrated in FIG. 8 to thereby provide an electrophotographic image forming apparatus capable of providing a high-quality electrophotographic image with consumption energy being suppressed.

EXAMPLES

Hereinafter, the present invention will be more specifically described using Examples.

Example 1

A high-purity truly spherical alumina (trade name: "Alunabeads CB-A25BC"; produced by Showa Titanium Co., Ltd.) as an inorganic filler was compounded with a commercially available addition-curable silicone rubber stock solution (trade name: SE1886; mixture of "A-liquid" and "B-liquid" produced by Dow Corning Toray Co., Ltd. in equal amounts) in 25% in a volume ratio based on a cured silicone rubber layer. Thereafter, vapor grown carbon fiber (trade name: "VGCF-S"; produced by Showa Denko K. K.) were further added in 2.0% in a volume ratio, and kneaded to provide a silicone rubber admixture.

Herein, the volume heat capacity ($C_p \cdot \rho$) of each of the fillers is as follows. Each physical property value was measured under an environment of 25° C.

High-purity truly spherical alumina "Alunabeads CB-A25BC": 3.03 [mJ/m$^3$·K]

Vapor grown carbon fiber "VGCF-S": 3.24 [mJ/m$^3$·K]

As a substrate, a nickel-plated, endless sleeve whose surface was subjected to a primer treatment, having an inner diameter of 30 mm, a width of 400 mm and a thickness of 40 μm, was prepared. Herein, in a series of production steps, the endless sleeve was handled while the core cylinder 13 illustrated in FIG. 4 being inserted therein.

The substrate was coated with the silicone rubber admixture by a ring coating method so that the thickness was 300 μm. The resulting endless belt was heated in an electric furnace set at 200° C. for 4 hours to cure the silicone rubber to obtain an elastic layer. The thermophysical property values and the hardness of the elastic layer can be measured by the following apparatus. Each physical property value was measured under an environment of 25° C. The resulting thermophysical property values can be used to calculate the thermal effusivity b of the elastic layer by using expression (4) below.

In the following expression (4), b denotes thermal effusivity (J/m$^2$·K·sec$^{0.5}$), λ denotes heat conductivity (W/(m·K)), Cp denotes specific heat at constant pressure (J/(g·K)), and ρ denotes density (g/m$^3$). In addition, the term "Cp·ρ" denotes heat capacity per unit volume (=volume heat capacity; J/m$^3$·K).

As a result, the thermal effusivity b of the elastic layer was 1.85[J/(m$^2$·K·sec$^{0.5}$)], and the hardness H was 10°. The result is shown in Table 1-1.

$$b=(\lambda \cdot Cp \cdot \rho)^{1/2} \quad (4)$$

Specific heat at constant pressure ($C_p$): Differential scanning calorimeter (trade name: DSC823e; manufactured by Mettler-Toledo International Inc.)

The measurement was performed according to JIS K 7123 "Testing methods for specific heat capacity of plastics". An aluminum pan was used as each of a sample pan and a reference pan. First, as a blank measurement, a measurement was performed which had a temperature program in which both the pans were kept empty at a constant temperature of 15° C. for 10 minutes, then heated to 115° C. at a rate of temperature rise of 10° C./min, and then kept at a constant temperature of 115° C. for 10 minutes. Then, about 10 mg of a synthetic sapphire having known specific heat at constant pressure was used for a reference material, and subjected to a measurement by the above temperature program. Then, about 10 mg of a measurement sample having a length of 20 mm, a width of 20 mm and a thickness of 250 μm cut out from the elastic layer (hereinafter, simply also referred to as "measurement sample") was set to the sample pan, and subjected to a measurement by the temperature program. The measurement results were analyzed using a specific heat analyzing software attached to the differential scanning calorimeter, and the specific heat at constant pressure ($C_p$) at 25° C. was calculated from the arithmetic average value of the measurement results for 5 times.

Density (ρ): Dry automatic densimeter (trade name: Accupyc 1330-01; manufactured by Shimadzu Corporation)

A 10 cm$^3$ specimen cell was used, and a crushed measurement sample was placed in the specimen cell in a volume of about 80% of the cell volume. After the weight of the specimen was measured, the cell was set to a measurement portion in the apparatus and subjected to gas replacement using helium as a measurement gas 10 times, and then the volume was measured 10 times. The density (ρ) was calculated from the weight of the specimen and the volume measured.

Heat conductivity (λ): periodic heating method-thermophysical property measurement apparatus (trade name: FTC-1; manufactured by Ulvac-Riko, Inc.) was used to measure heat diffusivity (α) by the method according to ISO22007-3, deriving heat conductivity (λ) from $\lambda=\alpha \cdot C_p \cdot \rho$. The sample was cut out so as to have an area of 8×12 mm for preparation, and set to a measurement portion of the apparatus to measure heat diffusivity (α). From the heat diffusivity (α) obtained from the arithmetic average value of the measurement for 5 times, and the specific heat at constant pressure ($C_p$) and the density (ρ) determined above, the heat conductivity (λ) was calculated according to a relationship of $\lambda=\alpha \cdot C_p \cdot \rho$.

Hardness (H): a micro rubber hardness tester (trade name: MD-1 capa TYPE-A; manufactured by Kobunshi Keiki Co., Ltd.) was used and samples were superposed so as to have a thickness of 2 mm or more for measurement.

While the surface of the endless belt being rotated at a movement speed of 20 mm/sec in the circumferential direction, an ultraviolet lamp placed at a distance of 10 mm from the surface was used to irradiate the elastic layer with ultraviolet ray. A low pressure mercury ultraviolet lamp (trade name: GLQ500US/11; manufactured by Harrison Toshiba Lighting Co. Ltd.) was used for the ultraviolet lamp to perform irradiation at 100° C. for 5 minutes in an air atmosphere.

After being cooled to room temperature, the surface of the elastic layer of the endless belt was coated with an addition-curable silicone rubber adhesive (trade name: SE1819CV; mixture of "A-liquid" and "B-liquid" produced by Dow Corning Toray Co., Ltd. in equal amounts) in a substantially uniform manner so that the thickness was about 20 μm.

Then, a fluororesin tube (trade name: KURANFLON-LT; produced by Kurabo Industries Ltd.) having an inner diameter of 29 mm and a thickness of 20 μm was stacked as illustrated in FIG. 4. Thereafter, the belt surface was uniformly squeezed from the top of the fluororesin tube, and thus an excessive adhesive was squeezed out from a space between the elastic layer and the fluororesin tube so that the tube was sufficiently thinned.

Then, the endless belt was heated in an electric furnace set at 200° C. for 1 hour to thereby cure an adhesive, securing the fluororesin tube on the elastic layer. Both ends of the resulting endless belt were cut to provide a fixing belt having a width of 341 mm.

Figure 9:
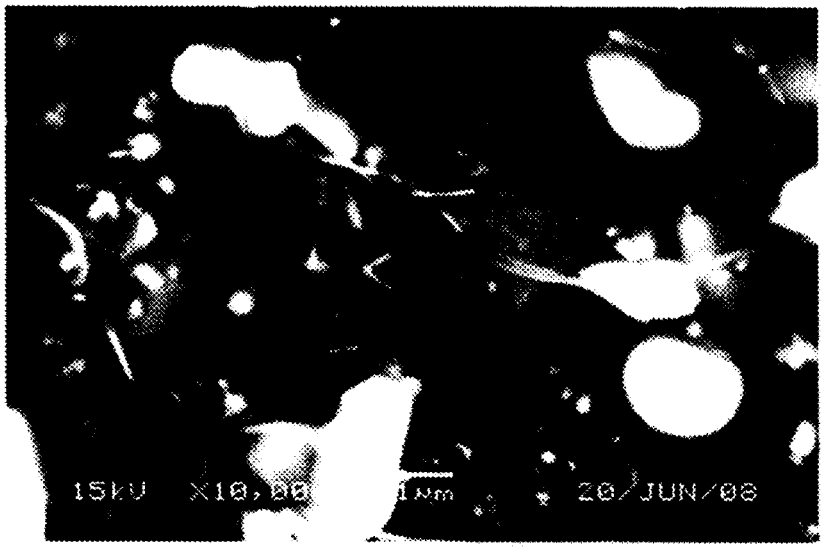
FIG. 9 is a scanning electron microscope (SEM) micrograph of a material of the elastic layer according to the present invention.
Figure 10:
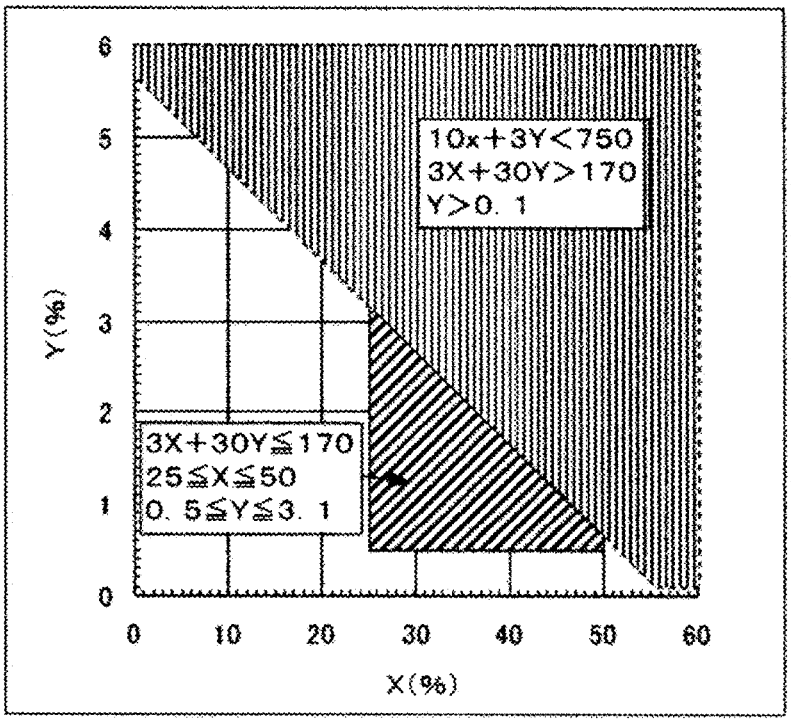
FIG. 10 is a graph by the expressions according to the invention of Japanese Patent Application Laid-Open No. 2010-92008.

With respect to the cutting surface of the fixing belt, an image of the elastic layer portion observed by a scanning electron microscope (SEM) is illustrated in FIG. 9. It is observed that the alumina particles compounded as the inorganic filler are bridged by the vapor grown carbon fiber to thereby form heat flow channels in the elastic layer.

The fixing belt was mounted to a fixing apparatus unit of a color laser printer (trade name: Satera LBP5910; manufactured by Canon Inc.) as illustrated in FIG. 6. The fixing unit was loaded on the main body of a color laser printer to form an electrophotographic image, and the fixing property and the melting unevenness of the resulting electrophotographic image were evaluated by the following methods. As a result, as shown in Table 1-1, an extremely high-quality electrophotographic image was obtained.

The evaluation methods are as follows.

(Evaluation Method of Fixing Property)

A rubbing test is a method for evaluating what degree a toner is strongly fixed to paper, and provides an index of degree of the ability of the fixing member to supply heat to a toner.

A color laser printer to which the fixing belt was mounted was used in an environment of a temperature of 10° C. and a humidity of 50% at an input voltage of 100 V to continuously fix a fixing property evaluation image for 50 sheets. Paper used was A4 size recycled paper (trade name: Recycled Paper GF-R100; manufactured by Canon Inc., thickness: 92 μm, basis weight: 66 g/m$^2$, rate of used paper blended: 70%, Bekk smoothness: 23 seconds (measured by the method according to JIS P8119)). The fixing property evaluation image was an image in which a patch image of 5 mm×5 mm in which a halftone of a check flag pattern of 2×2 dot was formed by a black toner single color was arranged at 9 points in a paper sheet.

After printing, samples for predetermined sheets (1, 10, 20 and 50$^{th}$ sheets) were taken out from the 50 sheets. An image forming surface of each of the samples was rubbed in a reciprocating manner 5 times in the state where a weight having a predetermined weight (200 g) was loaded on the image forming surface with silbon paper (trade name: Dusper K-3; manufactured by Ozu Corporation) interposed therebetween, and the reflection density of the image was measured before and after such rubbing. A densitometer (trade name: RD918; manufactured by GretagMacbeth) was used for measuring the reflection density.

The density reduction rate was calculated as follows:

(Density before rubbing−Density after rubbing)/Density before rubbing×100(%).

When the fixing property is best, namely, no evaluation image is lost at all, the density reduction rate is 0%. On the contrary, when the fixing property is worst, namely, the evaluation image is fully lost, the density reduction rate is 100%. A higher density reduction rate exhibits a worse fixing property.

The indication of the numeral value of the toner fixing property is as follows: in an environment of a temperature of 10° C. and a humidity of 50%, when the density reduction rate is 30% or more, a toner image can be lost from paper under a usual use environment; when the density reduction rate is 20% or more and less than 30%, no problem occurs under a usual use environment, but a toner image can be lost from paper if an image surface is strongly folded; when the density reduction rate is 10% or more and less than 20%, no problem occurs under a usual use environment, but the reduction in density of a toner image can be caused if an image surface is strongly rubbed; and when the density reduction rate is less than 10%, no problem such as a reduction in density occurs under a usual use environment.

Therefore, with respect to the rating of the present fixing property evaluation, the density reduction rate of the image was determined at 9 points in the paper surface, and the worst value was adopted among the 9 values and evaluated according to the following criteria. Then, the worst value with respect to the density reduction rate and the evaluation rank in each of Examples and Comparative Examples were listed in the item "fixing property" in Table 1-1 and Table 1-2.

Evaluation rank:

A: the density reduction rate was less than 10%.

B: the density reduction rate was 10% or more and less than 20%.

C: the density reduction rate was 20% or more and less than 30%.

D: the density reduction rate was 30% or more.

(Evaluation Method of Melting Unevenness)

The melting state of a toner after a toner image formed on paper is fixed is observed, and the result can be defined as the index of the following property of the fixing member to the irregularities of the paper.

A color laser printer to which the fixing belt was mounted was used in an environment of a temperature of 10° C. and a humidity of 50% at an input voltage of 100 V to continuously fix a melting unevenness evaluation image for 10 sheets. Paper used was the same as the paper used for the fixing property evaluation. The melting unevenness evaluation image was an image in which a patch image of 10 mm×10 mm formed using a cyan toner and a magenta toner in a density of 100% was arranged near the central portion of the paper surface.

The indication of the melting unevenness is as follows: heat and pressure are sufficiently applied to an image portion formed by 2 colors, to thereby melt the toners and mix the colors; when heat is applied and pressure is not applied particularly in concave portions of irregularities of paper, the grain boundaries of the toners remain after fixing and thus the colors are not sufficiently mixed to result in melting unevenness; and when the fixing member cannot sufficiently follow the irregularities, pressure is applied to the convex portions to mix the colors, but the colors are insufficiently mixed in the concave portions. Therefore, in the rating of the present evaluation, the melting state in an image forming area was observed and thus confirmed.

After printing, the $10^{th}$ sample was taken out, and the image forming portion thereof was observed by an optical microscope to evaluate the melting unevenness. The evaluation criteria are as follows (see "melting unevenness" in Table 1-1 and Table 1-2).

Evaluation rank:

A: no toner boundaries were almost found even in concave portions of paper fibers, and colors were mixed in both concave portions and convex portions.

B: toner boundaries were partially found in concave portions of paper fibers, but colors were basically mixed in both concave portions and convex portions.

C: colors were mixed only in convex portions of paper fibers, and many toner boundaries were largely observed in concave portions.

Example 2 to Example 23 and Comparative Example 1 to Comparative Example 5

The type and the amount of each of the fillers (inorganic filler and vapor grown carbon fiber) in the silicone rubber admixture were changed as listed in Table 1-1 and Table 1-2. Each of fixing belts was prepared in the same manner as in Examples 1 excluding such changes, and the thermophysical properties and the hardness were evaluated. The thermal effusivity b of the elastic layer and the hardness H of the elastic layer are shown in Table 1-1 and Table 1-2.

In Examples 10 to 23 and Comparative Examples 1 to 5, the following respective fillers (inorganic filler, vapor grown carbon fiber) were used, and described together with the respective volume heat capacities ($C_p \cdot \rho$).

Examples 10 to 16: vapor grown carbon fiber (trade name: "VGCF"; produced by Showa Denko K. K.): 3.24 [mJ/m$^3$·K];

Example 17: magnesium oxide (trade name: Star Mag U; produced by Hayashi-Kasei Co., Ltd.): 3.24 [mJ/m$^3$·K];

Example 18: zinc oxide (trade name: LPZINC-11; produced by Sakai Chemical Industry Co., Ltd.): 3.02 [mJ/m$^3$·K];

Example 19: iron powder (trade name: JIP S-100; produced by JFE Steel Corporation): 3.48 [mJ/m$^3$·K];

Example 20: copper powder (trade name: Cu-HWQ; produced by Fukuda Metal Foil & Powder Co., Ltd.): 3.43 [mJ/m$^3$·K];

Example 21: nickel powder (trade name: Ni-S25-35; produced by Fukuda Metal Foil & Powder Co., Ltd.): 3.98 [mJ/m$^3$·K];

Example 22: silica (trade name: FB-7SDC; produced by Denki Kagaku Kogyo K. K.): 1.72 [mJ/m$^3$·K];

Example 23, Comparative Example 5: metallic silicon powder (trade name: M-Si300; produced by Kanto Metal Corporation): 1.66 [mJ/m$^3$·K]; and Example 1 to Comparative Example 5: vapor grown carbon fiber (trade name: "VGCF-H"; produced by Showa Denko K. K.): 3.24 [mJ/m$^3$·K].

In addition, the fixing belt produced in Comparative Example 1 was loaded on a color laser printer in the same manner as in Example 1, and an electrophotographic image for evaluation was formed. The fixing property and the melting unevenness of the resulting electrophotographic image were evaluated, and as a result, the evaluation rank of the melting unevenness was A. However, since the thermal effusivity of the elastic layer was low, the density reduction rate of the image was 37%, which was significantly reduced, and the evaluation rank of the fixing property was D.

On the other hand, the fixing belt produced in Comparative Example 3 was evaluated with respect to the image quality in the same manner, and as a result, the density reduction rate was 4% and the evaluation rank of the fixing property was A. However, the evaluation rank of the melting unevenness was C because many toner boundaries were observed in concave portions.

The evaluation results in Examples 1 to 16 and Comparative Examples 1 to 4 are shown in Table 1-1. In addition, the evaluation results in Examples 17 to 23 and Comparative Example 5 are shown in Table 1-2.

TABLE 1-1

| | Inorganic filler | | | Vapor grown carbon fiber | | | Heat conductivity of |
|---|---|---|---|---|---|---|---|
| | Type | Volume heat capacity [MJ/(m$^3$ · K)] | Volume percent compounded (X) [%] | Type (trade name) | Aspect ratio | Volume percent compounded(Y) [%] | elastic layer (λ) [W/(m · K)] |
| Example 1 | Alumina | 3.03 | 25 | VGCF-S | 100 | 2.0 | 1.75 |
| Example 2 | Alumina | 3.03 | 25 | VGCF-S | 100 | 3.1 | 1.85 |
| Example 3 | Alumina | 3.03 | 30 | VGCF-S | 100 | 2.5 | 1.95 |
| Example 4 | Alumina | 3.03 | 35 | VGCF-S | 100 | 1.0 | 1.50 |
| Example 5 | Alumina | 3.03 | 35 | VGCF-S | 100 | 2.0 | 1.85 |
| Example 6 | Alumina | 3.03 | 40 | VGCF-S | 100 | 0.5 | 1.65 |
| Example 7 | Alumina | 3.03 | 40 | VGCF-S | 100 | 1.6 | 2.05 |
| Example 8 | Alumina | 3.03 | 45 | VGCF-S | 100 | 1.0 | 2.05 |
| Example 9 | Alumina | 3.03 | 50 | VGCF-S | 100 | 0.5 | 1.80 |
| Example 10 | Alumina | 3.03 | 25 | VGCF | 50 | 3.1 | 1.70 |
| Example 11 | Alumina | 3.03 | 30 | VGCF | 50 | 2.5 | 1.75 |
| Example 12 | Alumina | 3.03 | 35 | VGCF | 50 | 1.0 | 1.15 |
| Example 13 | Alumina | 3.03 | 35 | VGCF | 50 | 2.0 | 1.45 |
| Example 14 | Alumina | 3.03 | 40 | VGCF | 50 | 1.6 | 1.65 |
| Example 15 | Alumina | 3.03 | 45 | VGCF | 50 | 1.0 | 1.70 |
| Example 16 | Alumina | 3.03 | 50 | VGCF | 50 | 0.5 | 1.45 |
| Comparative Example 1 | Alumina | 3.03 | 25 | VGCF-H | 40 | 2.0 | 0.70 |

TABLE 1-1-continued

| | | | | | | | |
|---|---|---|---|---|---|---|---|
| Comparative Example 2 | Alumina | 3.03 | 35 | VGCF-H | 40 | 2.0 | 0.85 |
| Comparative Example 3 | Alumina | 3.03 | 50 | VGCF-H | 40 | 2.0 | 2.00 |
| Comparative Example 4 | Alumina | 3.03 | 30 | VGCF-H | 40 | 10.0 | 6.00 |

| | Volume heat capacity of elastic layer [J/(m$^3$ · K)] | Thermal effusivity of elastic layer (b) [J/m$^2$ · K · sec$^{0.5}$)] | Hardness of elastic layer (H) | Fixing property [%] | Fixing property Rank | Melting unevenness |
|---|---|---|---|---|---|---|
| Example 1 | 1.96 | 1.85 | 10 | 8 | A | A |
| Example 2 | 1.97 | 1.91 | 12 | 6 | A | B |
| Example 3 | 2.04 | 1.99 | 12 | 5 | A | B |
| Example 4 | 2.09 | 1.77 | 7 | 10 | B | A |
| Example 5 | 2.10 | 1.97 | 9 | 5 | A | A |
| Example 6 | 2.15 | 1.88 | 10 | 7 | A | A |
| Example 7 | 2.17 | 2.11 | 15 | 4 | A | B |
| Example 8 | 2.23 | 2.14 | 15 | 4 | A | B |
| Example 9 | 2.30 | 2.03 | 14 | 5 | A | B |
| Example 10 | 1.97 | 1.83 | 10 | 9 | A | A |
| Example 11 | 2.03 | 1.88 | 10 | 7 | A | A |
| Example 12 | 2.09 | 1.55 | 6 | 19 | B | A |
| Example 13 | 2.10 | 1.74 | 8 | 11 | B | A |
| Example 14 | 2.17 | 1.89 | 14 | 7 | A | B |
| Example 15 | 2.23 | 1.95 | 13 | 6 | A | B |
| Example 16 | 2.30 | 1.83 | 12 | 9 | A | B |
| Comparative Example 1 | 1.96 | 1.17 | 6 | 37 | D | A |
| Comparative Example 2 | 2.10 | 1.34 | 8 | 30 | D | A |
| Comparative Example 3 | 2.32 | 2.15 | 20 | 4 | A | C |
| Comparative Example 4 | 2.16 | 3.60 | 20 | 4 | A | C |

TABLE 1-2

| | Inorganic filler | | | Vapor grown carbon fiber | | | |
|---|---|---|---|---|---|---|---|
| | Type | Volume heat capacity [MJ/(m$^3$ · K)] | Volume percent compounded (X) [%] | Type | Aspect ratio | Volume percent compounded (Y) [%] | Heat conductivity of elastic layer (λ) [W/(m · K)] |
| Example 17 | Magnesium oxide | 3.24 | 35 | "VGCF" | 50 | 1.0 | 1.20 |
| Example 18 | Zinc oxide | 3.02 | 35 | "VGCF" | 50 | 1.0 | 1.15 |
| Example 19 | Iron powder | 3.48 | 35 | "VGCF" | 50 | 1.0 | 1.25 |
| Example 20 | Copper powder | 3.43 | 35 | "VGCF" | 50 | 1.0 | 1.35 |
| Example 21 | Nickel powder | 3.98 | 35 | "VGCF" | 50 | 1.0 | 1.25 |
| Example 22 | Silica | 1.72 | 35 | "VGCF" | 50 | 1.0 | 1.20 |
| Example 23 | Metal silicon powder | 1.66 | 35 | "VGCF" | 50 | 1.0 | 1.30 |
| Comparative Example 5 | Metal silicon powder | 1.66 | 50 | "VGCF-H" | 40 | 2.0 | 1.30 |

| Example 17 | Volume heat capacity of elastic layer [J/(m$^3$ · K)] | Thermal effusivity of elastic layer (b) [J/m$^2$ · K · sec$^{0.5}$)] | Hardness of elastic layer (H) | Fixing property [%] | Fixing property Evaluation rank | Melting unevenness |
|---|---|---|---|---|---|---|
| Example 18 | 2.16 | 1.61 | 9 | 17 | B | A |
| Example 19 | 2.09 | 1.55 | 10 | 19 | B | A |
| Example 20 | 2.24 | 1.67 | 13 | 15 | B | B |
| Example 21 | 2.23 | 1.74 | 10 | 12 | B | A |
| Example 22 | 2.51 | 1.77 | 12 | 11 | B | B |

TABLE 1-2-continued

| | | | | | | |
|---|---|---|---|---|---|---|
| Example 23 | 1.63 | 1.40 | 10 | 26 | C | A |
| | 1.61 | 1.45 | 12 | 25 | C | B |
| Comparative Example 5 | 1.64 | 1.46 | 24 | 24 | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-282976, filed Dec. 26, 2012, and Japanese Patent Application No. 2013-251804, filed Dec. 5, 2013, which are hereby incorporated by reference herein in their entirety.

What is claimed is:

1. An electrophotographic fixing member comprising:

a substrate, an elastic layer and a releasing layer, wherein:

the elastic layer contains a silicone rubber, an inorganic filler and a vapor grown carbon fiber, wherein:

when a volume percent of the inorganic filler compounded in the elastic layer is designated as X (%) and a volume percent of the vapor grown carbon fibers compounded in the elastic layer is designated as Y (%), the following expression (1), expression (2) and expression (3) are satisfied, and wherein:

the vapor grown carbon fiber has an aspect ratio of 50 or more, the aspect ratio being a ratio of a fiber length to a fiber diameter, aspect ratio:

$$3X+30Y\leq 170 \quad (1)$$

$$25\leq X\leq 50 \quad (2)$$

$$0.5\leq Y\leq 3.1 \quad (3).$$

2. The fixing member according to claim 1, wherein the aspect ratio of the vapor grown carbon fiber is 50 or more and 100 or less.

3. The fixing member according to claim 1, wherein an average fiber diameter of the vapor grown carbon fiber is 80 to 200 nm.

4. The fixing member according to claim 1, wherein an average fiber length of the vapor grown carbon fiber is 5 to 15 μm.

5. The fixing member according to claim 1, wherein a volume heat capacity of the inorganic filler is 3.0 [MJ/m$^3$·K] or more.

6. The fixing member according to claim 1, wherein the inorganic filler is made of at least one selected from the group consisting of alumina, magnesium oxide, zinc oxide, iron, copper and nickel.

7. The fixing member according to claim 1, wherein an average particle diameter of the inorganic filler is 1 to 50 μm.

8. The fixing member according to claim 1, wherein an average value of a ratio of a maximum length to a minimum length in a projection image of the inorganic filler is 1 to 2.

9. The fixing member according to claim 1, wherein the fixing member has an endless belt shape, and a thickness of the elastic layer is 100 μm or more and 500 μm or less.

10. The fixing member according to claim 1, wherein the fixing member has a roller shape, and a thickness of the elastic layer is 300 μm or more and 10 mm or less.

11. A fixing apparatus comprising the fixing member according to claim 1, and a heating unit of the fixing member.

12. An electrophotographic image forming apparatus comprising the fixing apparatus according to claim 11.

* * * * *